US007841311B2

(12) United States Patent
Hutcheson et al.

(10) Patent No.: US 7,841,311 B2
(45) Date of Patent: Nov. 30, 2010

(54) VARIABLE VALVE TIMING DEVICE

(75) Inventors: Jack D. Hutcheson, Garland, TX (US); Andreas Knecht, Kusterdingen (DE); Dirk Pohl, Kirchentellinsfurt (DE); Glenn A. Barton, Lake Orion, MI (US); Stephen L. Nance, Highland Village, TX (US); Joe S. Cole, Mesquite, TX (US)

(73) Assignee: Hilite International Inc., Nuertingen (DE)

( * ) Notice: Subject to any disclaimer, the term of this patent is extended or adjusted under 35 U.S.C. 154(b) by 372 days.

(21) Appl. No.: 12/006,828

(22) Filed: Jan. 4, 2008

(65) Prior Publication Data

US 2009/0173297 A1 Jul. 9, 2009

(51) Int. Cl.
*F01L 1/34* (2006.01)

(52) U.S. Cl. ..... 123/90.17; 123/90.15; 464/160

(58) Field of Classification Search ..... 123/90.15, 123/90.16, 90.17, 90.18; 464/160
See application file for complete search history.

(56) References Cited

U.S. PATENT DOCUMENTS

| | | | |
|---|---|---|---|
| 2,911,956 | A | 11/1959 | Smith, Jr. |
| 4,332,222 | A | 6/1982 | Papez |
| 5,233,948 | A | 8/1993 | Boggs et al. |
| 5,235,939 | A | 8/1993 | Levin et al. |
| 6,076,492 | A | 6/2000 | Takahashi |
| 6,253,719 | B1 | 7/2001 | Methley |
| 6,546,842 | B2 | 4/2003 | Raikamo |
| 6,725,817 | B2 | 4/2004 | Methley et al. |
| 6,814,036 | B2 | 11/2004 | Palesch et al. |
| 6,945,205 | B2 | 9/2005 | Heintzen et al. |
| 7,270,096 | B2 * | 9/2007 | Lancefield et al. ..... 123/90.17 |
| 2003/0177991 | A1 | 9/2003 | Palesch et al. |
| 2007/0034182 | A1 | 2/2007 | Dengler |
| 2007/0039411 | A1 | 2/2007 | Lechner et al. |
| 2007/0240657 | A1 | 10/2007 | Schneider |

FOREIGN PATENT DOCUMENTS

| | | |
|---|---|---|
| DE | 36 24 827 | 2/1988 |
| DE | 43 32 868 | 3/1995 |
| DE | 199 14 909 | 10/2000 |
| DE | 10 2004 024 222 | 3/2005 |
| DE | 10 2005 014 680 | 8/2006 |
| EP | 0 397 540 | 11/1990 |
| EP | 1 347 154 | 9/2003 |
| JP | 11-173120 | 6/1999 |
| WO | 92/12333 | 7/1992 |
| WO | 01/12996 | 2/2001 |
| WO | 2005/040562 | 5/2005 |

* cited by examiner

*Primary Examiner*—Ching Chang
(74) *Attorney, Agent, or Firm*—Lipsitz & McAllister, LLC

(57) ABSTRACT

The present invention provides a variable valve timing device for an internal combustion engine having a double camshaft. A gas exchange valve control shaft is provided which has first and second concentrically arranged cam shafts that are adjustable in a rotatable manner with respect to each other, by which a cam of the first cam shaft is adjusted in terms of its angle towards a cam of the second cam shaft. A cam phasing device is provided which operates by rotatable vanes provoking a swivelling relative movement between a driven member and an output member. The cam phasing device comprises at least two pivotable vane adjusters. Each pivotable vane adjuster is assigned to one of the two cam shafts. The pivotable vane adjusters are arranged axially one after the other in a direction of a valve control shaft. Each pivotable vane adjuster may be designed as a rotor-type vane adjuster.

8 Claims, 9 Drawing Sheets

C-C

D-D

E-E

F-F

VARIABLE VALVE TIMING DEVICE

FIELD OF THE INVENTION

The present invention refers to a variable valve timing device usable with and for in internal combustion engine.

BACKGROUND OF THE INVENTION

EP 1 347 154 A2 shows a swivel-type adjuster that is designated to be used with a control shaft of a variable valve train. A first hydraulic rotatable mechanism is connected to a second hydraulic rotatable mechanism so that by choosing a raw adjustment and by choosing a fine tuning adjustment an exact position for an eccenter of the variable valve train can be picked. Accordingly, it can be said that the angular position of the eccenter is depicted by a two-stage system.

U.S. Pat. No. 2,911,956 describes a plate-like shaft positioner by which a swivel movement of a first plate influences the swivel range of a second plate and so forth.

WO 01/12996 shows in FIG. 5a a two stator vane cam phasing system in which a rotor is limited in its swivel movements by rotating first and second stator.

Further, by studying U.S. Pat. No. 5,233,948 a person skilled in the art would realize that many advantages can be found by a camshaft with cams that can be superposed. Consequently, for many years there has been a need to design some kind of phase adjuster that can operate such a camshaft. However, practical solutions that actually work in an engine environment can rarely be found. As in U.S. Pat. No. 5,233,948, many basics are only laid open on a theoretical level but there is no teaching how to make them work in practice.

Attempts how to make such camshafts work can be derived from FIGS. 4*a*, 4*b*, 4*c* of U.S. Pat. No. 5,235,939. In this document, the figures show a coaxially arranged double camshaft with at least two sets of cams which are offset by an angle. The cams are mounted by fastening pins and fastening clips onto the bearing camshaft. A similar embodiment can be found in WO 2005/040 562 A1. The documents teach a type of hydraulic linear cylinder to select certain positions for the cam. Further, a similar design is shown in FIG. 1 of DE 43 32 868 A1. A further linear adjustable device for camshafts is shown in EP 0 397 540 A1. A different system can be seen in FIGS. 5 and 6 of U.S. Pat. No. 4,332,222 in which a contour bearing pin determines the angle of two cams and by that the position of the camshaft. A document that teaches a very simple and light hollow camshaft is DE 36 24 827. The hollow camshaft taught in that document is, however, outdated in the meantime because nowadays both camshafts have to offer a phase adjustment option. Further reasoning for creating a special contour of a cam can be found in DE 199 14 909 A1, which shows an auxiliary cam for adjusting the contour of the main cam with the purpose to control the gas exchange valves a second time. For reasons of completeness, the two documents JP 11 17 31 20 and WO 1992 012 333 are named.

From the foregoing prior art, it can be concluded that for years and years the industry has been looking for a workable design which enables the adjusting of the phasing of occurrences in a gas exchange valve train.

The further graphical representation of a double camshaft can be seen in DE 10 2005 014 680 A1 wherein the graphics stop at the oil distribution bearing. It may be assumed that the Applicant stopped at the point because further components were still needed. The document WO 2005/040562 describes a camshaft with at least two cams. The cams are axially arranged and displaceable. However, the document falls short in teaching how to operate the camshaft in a combustion engine.

A first sprocket and a second sprocket for a cam phaser attached to a hollow camshaft can be seen in U.S. Pat. No. 6,253,719 B1. Instead of arranging both sprockets in parallel, a different design is shown in U.S. Pat. No. 6,725,817 B2. A first cam phaser that is the inner cam phaser is surrounded by a second cam phaser that is the outer cam phaser. In the meantime, it is known from many different car manufacturers that both types of systems do not work as expected. There is a need to enhance the possible angle of adjustment.

U.S. Pat. No. 6,076,492 shows that it is widely known that the alignment of a cam phaser, a cylinder head, and a control valve together with a camshaft in a stationary manner is quite difficult. For example, one difficulty can be found by the canting of the components one to the other.

The described embodiments in the prior art of two offsetable and adjustable gas exchange valve actuation means on one single control shaft have been discussed above to include and incorporate them in the specification in order to enhance the specification and to lead the reader to the more challenging aspects of the present invention.

A gas exchange valve control shaft comprising two camshafts encroaching each other preferably coaxially arranged with the outer camshaft surrounding the inner camshaft, is also referred to as a double camshaft. A double camshaft is a camshaft which is assembled from two pieces. Persons skilled in the art often associate only one single shaft when hearing a camshaft of which all cams are placed in stationary relationship one to the other. A camshaft within the scope of the present invention is a camshaft of one, two or even more camshafts, especially camshafts having the same axle.

SUMMARY OF THE INVENTION

It is desirable to offer a cam phasing device as part of a variable valve timing device that is applicable to internal combustion engines. Especially with camshafts that comprise adjustable cams for intake and exhaust gas exchange valves on the same camshaft, a cam phaser device may be needed. Advantageously, any kind of camshaft can be operated that has two different sets of cams on the very same camshaft. The device shall be applicable in an automotive environment as an automotive component.

A variable valve timing device of an internal combustion engine is a device that changes or adapts the relative position of a gas exchange valve actuating component like a cam in respect to a further shaft like a crankshaft. It is widely known to use camshafts for transmitting the actuating impulse. The impulse is applicable on at least one—normally several—gas exchange valves via a control shaft. The control shaft is of a kind that the shaft has at least two concentrically arranged camshafts. The camshafts are adjustable in a rotatable manner with respect to each other. The adjustment is achieved by adjusting a cam of the first camshaft in terms of its angle towards a cam of the second camshaft. To select the position, a cam phasing device is needed. The cam phasing device operates by rotatable vanes provoking a swivelling relative movement between a driven member and an output member. In one embodiment the vanes are profiled. In a further embodiment, the vanes are flat, three-dimensional blocks extending out of a central rotor which can be referred to as rotor cores. Central rotor and vanes are part of a vane adjuster. The cam phasing device comprises at least two pivotable vane adjusters. Each pivotable vane adjuster is assigned to one of the two camshafts. In particular, a first vane adjuster is fixed to a first camshaft and a second vane adjuster is fixed to a second camshaft. The first vane adjuster operates the first camshaft whereas the second vane adjuster operates the second camshaft. The pivotable vane adjusters are arranged axially one after the other in a direction of a valve control shaft. Both vane adjusters are on a common axis. The vane adjusters do not influence each other in their maximum swivel range. The first vane adjuster may still cover its full range while the second vane adjuster has picked any position between its maximum advanced and its maximum retarded position. With this design, the position of a first a camshaft does not influence the selectability of a position for the second camshaft still occupying the same elongated space.

The variable valve timing device further comprises rotor type vane adjusters in that each pivotable vane adjuster is designed in a rotor-type manner. Each rotor type vane adjuster can be changed in respect of its phase by hydraulic pressure in two sets of hydraulic chambers. The phase is measured in respect of a further shaft like the camshaft. The two sets of hydraulic chambers form counter moving chambers to each other. The pivotable vane adjusters each constitute an output member of one of the cam-shafts. Each output member comprises a vane rim. The vane rims are attached to rotor cores being movable between a first position and a second position limited by division bars of a surrounding stator housing. By using the design of vane type cam phasers—which are known to a certain extent by themselves—a very fast and very responsive adjuster can be created.

The variable valve timing device has a double camshaft. The gas exchange valve control shaft is a coaxially arranged double camshaft. Of that double camshaft the first camshaft is formed as an hollow body and in the hollow body the second camshaft is aligned and placed in a manner so that through at least one recess a cam of the second camshaft pokes out to an outside of the first camshaft. The double camshaft is very efficient in terms of space. It occupies very little additional space outside of the camshaft as is necessary and advantageous in internal combustion engines.

The variable valve timing device has only one drive pulley. The drive pulley is exposed to a driving means like a chain or a belt. The cam phasing device has only one drive pulley such as a sprocket adapted to be driven by a chain which can surround a crankshaft of the internal combustion engine. The variable valve timing device has a side which is a near side of the camshaft, and the variable valve timing device has a side which is a far side from the camshaft. The variable valve timing device is planar. The variable valve timing device has a communication collar on the near side. The near side bears conduits for intake and piping of a hydraulic fluid to each of the sets of chambers of the first and said second pivotable vane adjuster. The communication collar moves synchronously along with the drive pulley. The integration of hydraulic conduits for the first and second vane adjuster contributes to the compactness of the variable valve timing device. The same applies to using only one drive pulley.

The variable valve timing device has at least four conduits. Two of the four conduits are located in the vicinity of an axis of the camshaft which channel fluid from the communication collar to the pivotable vane adjuster. They conduct hydraulic fluid like engine oil to the vane adjuster which is located farther away from the communication collar than the second pivotable vane adjuster. The two of the four conduits are located remotely to the axis of the camshaft channel from the communication collar to the second pivotable vane adjuster. The second vane adjuster is located nearer to the communication collar. In a very dense circular cross section all conduits necessary for operation can be placed in the rotor core and the core of the variable valve timing device.

In a further advantageous embodiment, the variable valve timing device bears an oil distribution adapter. The oil distribution adapter is centered in the cam phasing device. The cam phasing device is penetrated by at least four longitudinal fluid passages. In one embodiment, each one of the fluid passages is of a different length. The fluid passages open out into one of the sets of hydraulic chambers. This alternative design in respect of oil distribution can be easily manufactured while being still very reliable.

The variable valve timing device has at least two output members. One of the output members is located farther away from the gas exchange valve control shaft and operates the camshaft which is an inner camshaft in comparison to the second camshaft. One of the output members is located nearer to the gas exchange valve control shaft and operates the camshaft which is an outer camshaft and encloses the inner camshaft. The output member which is farther away is screwed to the inner camshaft whereas the output member which is located nearer to the gas exchange valve control shaft is shrink fitted on the outer camshaft. The type of fixation is a fast and reliable method for fixing the vane adjusters to the camshafts.

The variable valve timing device has four hydraulic ports. The four hydraulic ports are placed in the communication collar. The ports form channels from a stationary part such as a cylinder head of the internal combustion engine to each set of hydraulic chambers of each pivotable vane adjuster so that the communication collar forms part of a bearing ring. By this means, the hydraulic fluid is tuneable in each channel. Each vane adjuster can take up a desirable position independent from the other vane adjuster.

The variable valve timing device has a spring. The spring can be a coil spring. The spring can be designed as an inlay in the driven member. The spring props on one side against the pulley and pushes one of the pivotable vane adjusters in a pre-selected state. Preferably, the intake valves take on a pre-selected position in case of emergency or uncontrolled hydraulic pressure. As a result, the internal combustion engine may be operated even when the hydraulic circuit does not work as anticipated.

BRIEF DESCRIPTION OF THE DRAWINGS

The present invention will hereinafter be described in conjunction with the appended drawing figures, wherein like reference numerals denote like elements, and.

DETAILED DESCRIPTION

The ensuing detailed description provides exemplary embodiments only, and is not intended to limit the scope, applicability, or configuration of the invention. Rather, the ensuing detailed description of the exemplary embodiments will provide those skilled in the art with an enabling description for implementing an embodiment of the invention. It should be understood that various changes may be made in the function and arrangement of elements without departing from the spirit and scope of the invention as set forth in the appended claims.

Figure 1:
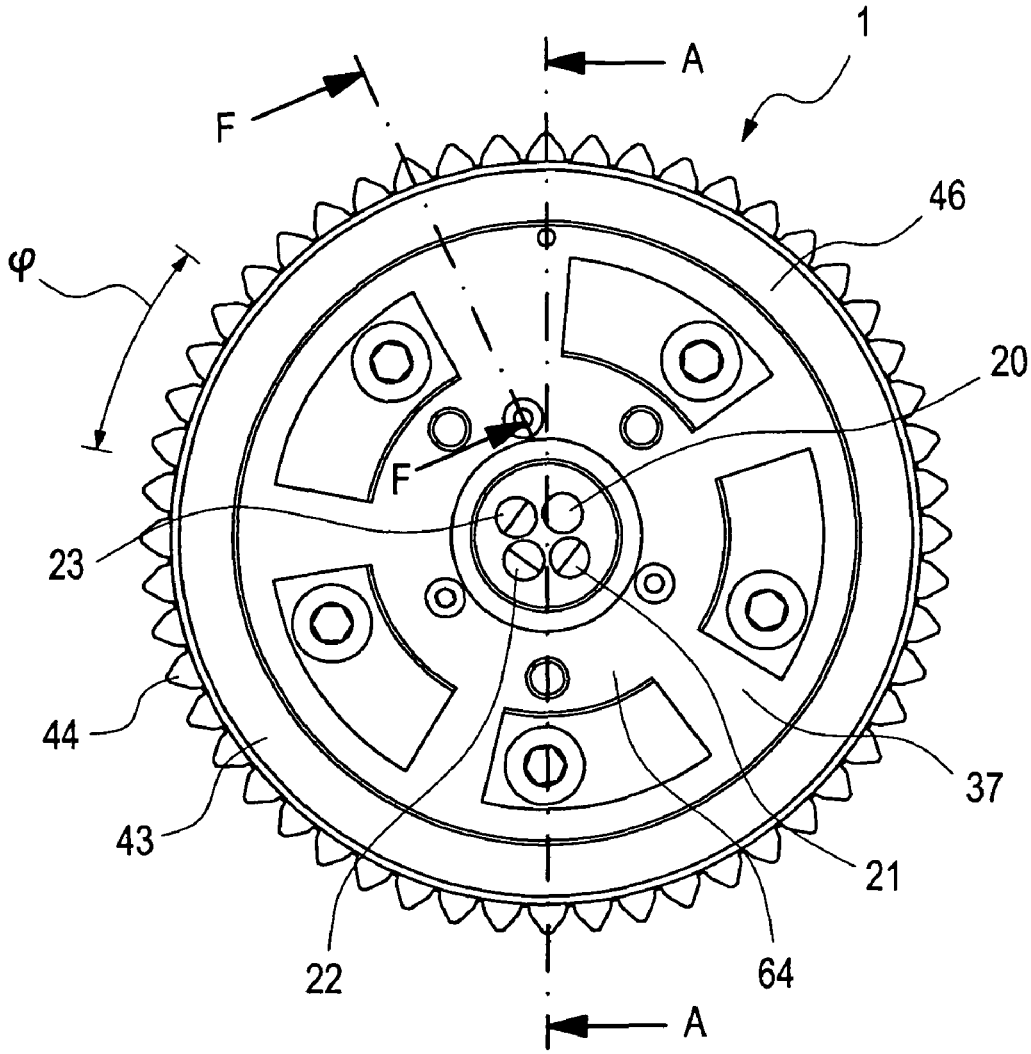
FIG. 1 shows an opened cam phasing device in accordance with a first example embodiment of the present invention.

FIG. 1 shows a cam phasing device 1 which operates as a rotatable vane phasing device. The rotatable vane phasing device can swivel within a certain range of angle $\phi$ freely from one side to a second side. The rotation is caused and provoked by oil out of fluid passages 20, 21, 22, 23 by which counteracting chambers 67, 68 (refer to FIG. 4) are loaded. The cam phasing device 1 can be designed as a double-cam phasing device if driven by one single drive wheel 43. In the example shown, the drive wheel 43 is a sprocket 44. Sprockets 44 stand out by a reduced slipping. The outer cover of the cam phasing device 1 serves as one consistent drive torso 46. In its center, the cam phasing device 1 is arranged with at least two output members 62, 63 (refer to FIGS. 4 and 6) setup on the same axis. Centrally, a vane rim 64 which is underneath the shown signal plate 37 is placed two times exactly identically adjacent one next to the other in the cam phasing device 1.

Figure 2:
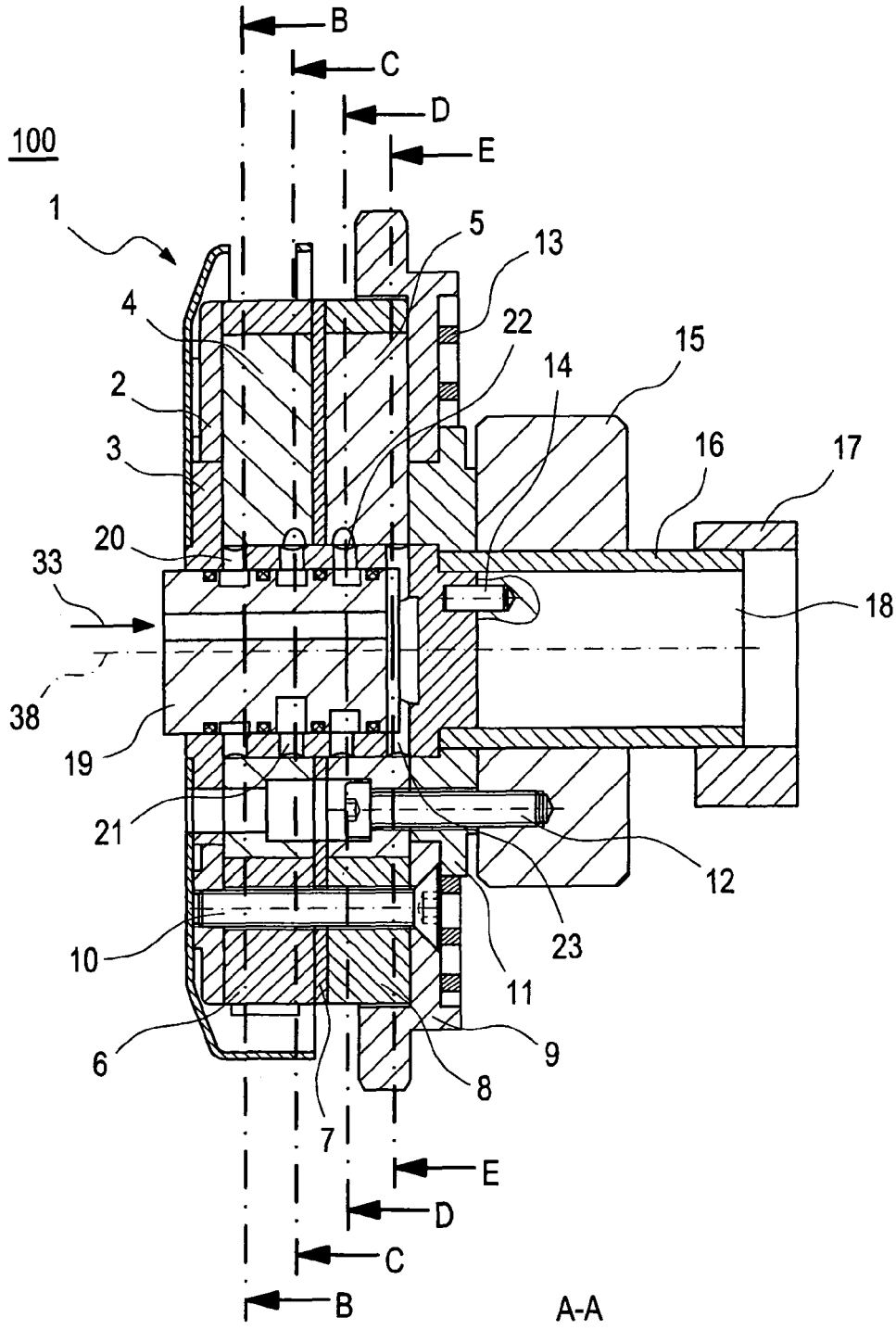
FIG. 2 shows an example cam phasing device along the line A-A of FIG. 1.

FIG. 2 shows the inner construction of a cam phasing device 1 in a sectional view along the line A-A of FIG. 1. It can be seen that the cam phasing device 1 is a layered phasing device whereas in its inner part two rotors 4, 5 are located. The inner rotor 5 is placed closer to the camshafts 16, 18 which form one unified camshaft. The camshafts 16, 18 pass through the exact same camshaft bearing 17 which bears the inner centrally placed camshaft 18 by the outer camshaft 16. The rotors 4, 5 are separated by a center plate 7. Components 4, 5, 7 of the cam phasing device 1 are arranged in layers and span between the front plate 2 and the back plate 9. The center plate 7 separates as one piece the rotors 4, 5. Center plate 7 and the stators 6, 8 are arranged stationarily in a rototable manner. The front plate 2 is centered by a spindle 3 for the camshafts 16, 18 to be attached to. An oil distribution adapter 19 with numerous channels ensures the oil distribution towards the chambers of the cam phasing device 1. The oil distribution adapter 19 has at least four supply channels 20, 21, 22, 23. As it can be seen in FIGS. 3 to 6, the fluid passages lead into at least four passages 24, 25, 26, 27. The camshafts 16, 18 are guided by at least one common retainer 14. The camshafts 16, 18 are circumscribed by at least one journal 15. The cam phasing device 1 is attached to the camshaft by an adapter 11. A1l the components 2, 6, 7, 8, 9 of the cam phasing device 1 can be braced by at least one screw 10 such as a countersunk screw 12 and can be screwed in a stationary manner. Both rotors 4, 5 can rotate relatively to the braced components from a first bar 65 to a second bar 66 (refer to FIG. 3). At least one of rotors 4, 5, very often the rotor that is attached to the intake camshaft, is pushed by a spring 13 which can be a spiral spring, into a predetermined position, especially if the chambers 67, 68 are without oil or without pressure. The camshafts 16, 18 are part of the valve train 100. Facing the camshaft device 1 is an inflow 33 for a hydraulic fluid so that parallel to the camshaft axis 38 a hydraulic fluid can be provided to each rotor 4, 5.

In FIG. 2, four lines B-B, C-C, D-D, E-E are marked which can be seen in further details in FIGS. 3 to 6, respectively. The lines B-B and C-C pass through the first rotor 4 and the lines D-D and E-E pass through the second rotor 5. In the drawings 3 to 6, the oil supply is realized by at least four parallelly extended fluid passages 20, 21, 22, 23 following the valve train axis whereas each channel opens out into a passage annulus 24, 25, 26, 27. Both rotors 4, 5 have a similar swivel range. The swivel range is determined by the angle of the bars 65, 66. Each rotor 4, 5 has at least a first chamber 67 and a second chamber 68. Several chambers of the same type—if existing several times—form one set 69 of first chambers and a second set 70 of second chambers in each area of the cam phasing device. The oil supply is delivered in this respect for all four systems of chambers via the center 71 of the cam phasing device 1. Each rotor 4, 5 (refer to FIG. 2) forms an output member 62, 63 (refer to FIGS. 4, 6) for a camshaft 16, 18. The output members 62, 63 are beaded along one common axis 38 of the camshaft. In at least one of the rotors 4, 5 a locking pin 34 for locking the rotor 4 to the stator 6 while being in a special state of operation can be inserted. In this respect, in one drive torso 46 there are a first and a second rotor 4, 5. On the vane rim 64 which is located centrally, rotor vanes extend outwardly.

Figure 7:
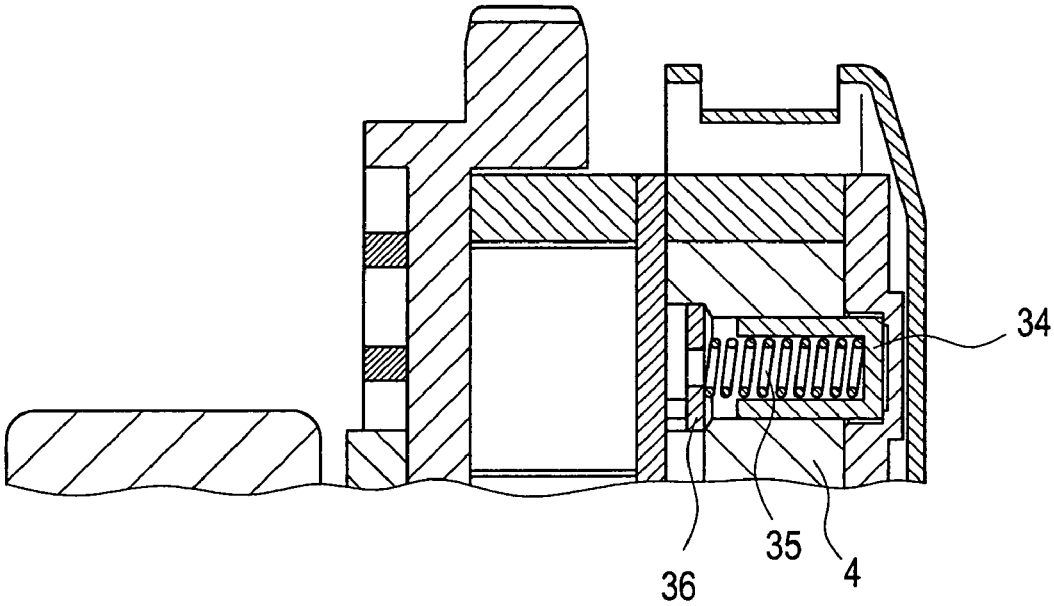
FIG. 7 shows an example cam phasing device of FIG. 1 along a further line F-F of FIG. 1 around a locking pin.

One example embodiment of a locking mechanism comprising the components locking pin 34, lock spring 35, and spring plate 36 is shown in FIG. 7. Of course, several locking pins can be placed in one rotor 4, 5.

The cam phasing device 1 in accordance with FIG. 2 receives the hydraulic media like oil via one face. The input place, the inflow 33 for the oil, is located in the oil distribution adapter 19.

Figure 8:
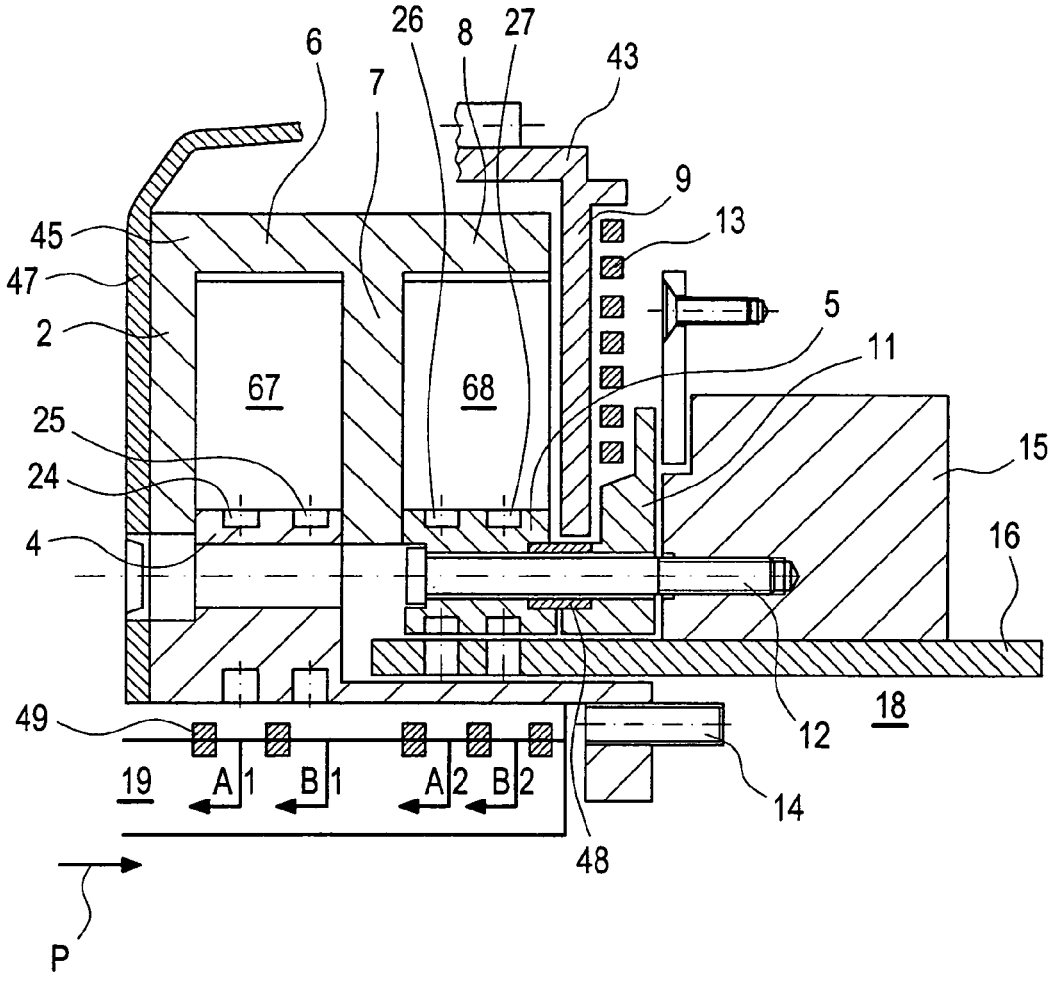
FIG. 8 shows a further example embodiment of the present invention in schematic view.

A further example embodiment in accordance with the invention can be seen in FIG. 8, which shows a cam phasing device 1 designed as a double cam phasing device of the swivel type. For better presentability the individual components like stator housing 45, camshafts 16, 18 and rotors 4, 5 are drawn with a certain distance in between whereas the components can be produced by casting, embossing or rolling. Each rotor can reach within its swivel range every position independently from the other rotor. Both rotors 4, 5 are uncoupled. They are placed in the same stator housing 45. The stator housing 45 is one single piece—as graphically shown—which is coherent and comprises several chambers. The housing 45 can be produced, as an example only, as a casting component. Certain areas of the stator housing 45 can be designated by front plate 2, first stator 6, center plate 7 and second stator 8. The areas 2, 6, 7 and 8 are cohesive. In a further alternative embodiment certain areas like the first stator 6 and the second stator 8 can be separated one from the other while being joinable. In this respect, the same component can be reproduced and joined two times. In the spaces between the first rotor 4 and the first stator 6 chambers 67 are formed. Likewise chambers 68 are shaped between the second stator 8 and the second rotor 5. In each rotor 4, 5 at least two passages 24, 25, 26, 27 are drilled. A1ong the oil distribution adapter 19, which can be comprised of several components and with multiple channels, the hydraulic media flows in at least four hydraulic pressure systems towards chambers which are placed at the end of the channels. The hydraulic media is under pressure P when provided to one of the chambers 67, 68 for provoking a swivel movement. The hydraulic pressure system is symbolized by the letters A1, B1, A2, B2. The hydraulic separation of the hydraulic systems is secured by sealings 49 which are in-line adjacent one after the other represented schematically. The outer rotor 4 extends through its middle towards the camshaft 18 while being circumscribed by the inner rotor 5. The inner camshaft 18 is circumscribed by the outer camshaft 16. The rearward outer rotor 4 can be mounted in one advantageous embodiment by a retainer 14 to the camshaft 18 (as shown in FIG. 8). To protect the stator housing 45, a lid 47 of the cam phasing device 1 can be mantled to cover the inner part of the cam phasing device 1. The lid 47 opens out into the drive wheel 43 which is formed to meet with the driving belt surface to surface. The drive wheel 43 is part of the back plate 9. A spring 13 is inlaid in the back plate 9 which presses at least one of the rotors 4, 5 in an advantageous position. The receiving space for the spring 13 is located between the rear plate 9 and the adapter 11. The rear adapter 11 takes care of an easy mounting of the rotor 5 onto the outer camshaft 16. The rotor 5 is screwed to the first journal 15 by a countersunk screw 12. The rotor 5 has a smaller volume than the second rotor 4 arranged in parallel. For the mounting, normally several countersunk screws 12 are placed in a through-hole drilling from one of the rotors 4, 5. The screwing keeps the components tensioned. Pass-throughs of the screws 12 can be sealed by sealing sleeves 48. In FIG. 8 the cam phasing device 1 is only shown by its upper part in a schematic representation. A capable designer will be able to use the given instructions to create a double cam phasing device in accordance with the present invention which can be produced in industries.

Figure 9:
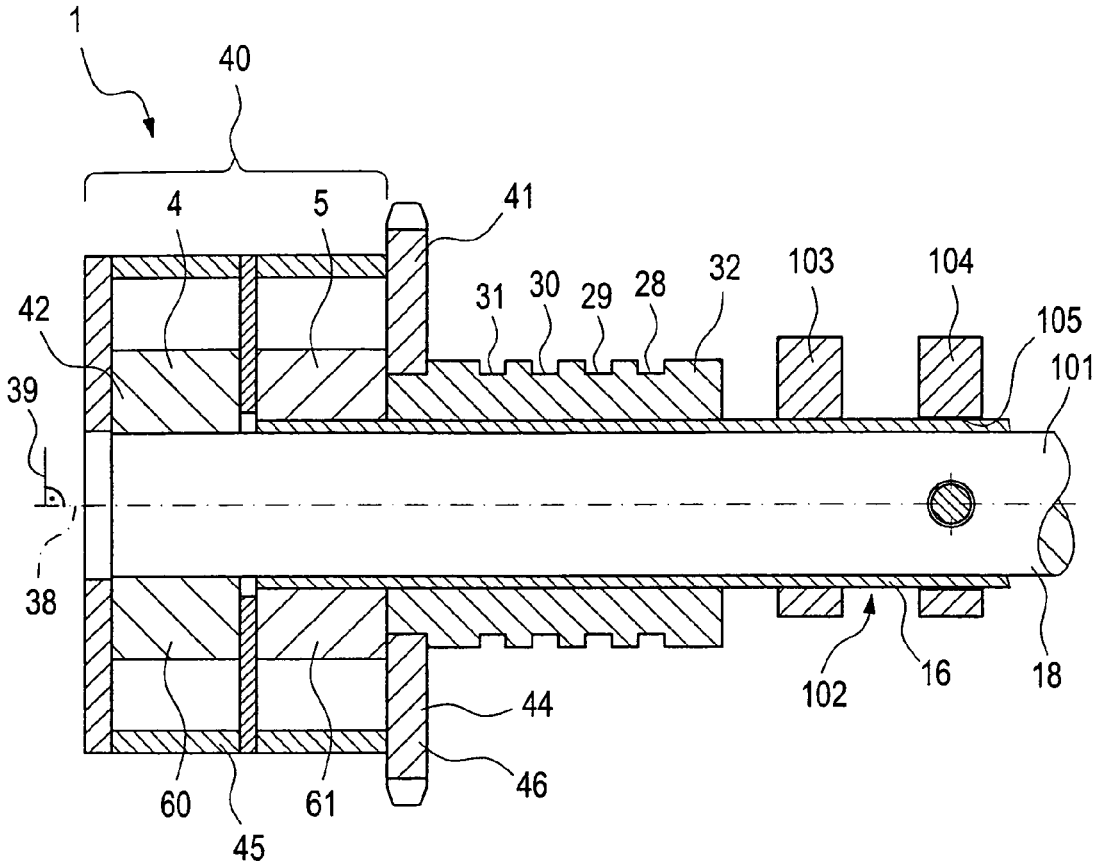
FIG. 9 shows a further example embodiment of the present invention in schematic view.

A further advantageous example embodiment of a cam phasing device 1 with two camshafts 16, 18 in accordance with the invention can be seen in FIG. 9. In FIG. 9, one can see in a schematic representation the mounting or arrangement of the (double) cam phasing device 1 with (double) camshaft 101 having at least two different sets of cams 103, 104. The double camshaft 101 comprises both camshafts 16, 18 which are placed coaxially. One of the sets of the cams 103 is fastened to the outer camshaft 16 while the second set of cams 104 is mounted to the inner camshaft 18 in a relative stationary position. By a swivel movement of one camshaft 16 to the second camshaft 18 the central control shaft 102 varies the opening and closing times of the gas exchange valves. The cam phasing device 1 has a near side 41 and a far side 42 to the camshaft. On the near side 41 is the drive torso 46 especially in the form of a sprocket 44. The cam phasing device 1 has an axial arrangement 40 of the individual layers 60, 61. A connection collar 32 encloses the double designed camshaft 101 at the end for offering an inflow of the hydraulic fluid for adjusting a phasing of the layers 60, 61. The connection collar 32 has several ports 28, 29, 30, 31 (e.g., at least four different ports 28, 29, 30, 31), all of which can be used as oil hand-over places. The first camshaft 16 has at least one recess 105 through which a cam 104 reaches to the outside of the double camshaft 101. The swivel movement of each layer 60, 61 will be transmitted directly and without conversion to one of the camshafts 16, 18 and by this the same swivel angle can be seen on the cams 103, 104. For this, all components are arranged along one single axis 38 of the camshaft 101. The rotors extend in a normal direction 39 from the camshaft axis 38.

A1though only three example embodiments of the present invention have been described in detail, it should be apparent to someone skilled in the art that the described embodiments can only be understood as examples that do not impose any limitation on the scope of the invention and how to realize the invention.

Consequently, the scope of the invention also includes the usage of more than just two individual rotors. The scope of the invention also covers a cam phasing device with and without additional adapters between camshafts and cam phasing device. The drive torso can be actuated by a crank shaft, by a belt, by meshing gears, and by an electric motor.

The present invention has many advantages. Only one single device is needed to operate and actuate two shafts. This contributes to the reduction in size and package. One component can be handled more easily and can be attached to the concentric camshaft easier than all devices known up to now.

In addition, by using two parallel plans for the rotors, the dual camshaft phaser, also called cam phasing device 1, is able to drive the dual concentric camshaft. The dual phaser consists of two individual phasers stacked at the end of the concentric camshafts 16, 18. The individual phasers drive the separate camshafts in the dual concentric camshafts. The two phasers are using common designed stators 6, 8 and rotors 4, 5 with a shared center plate 7. The stacked stators 6, 8 and rotors 4, 5 are sandwiched inside the sprocket with back plate 9 and the front plate 2. Screws 10 pass through the sprocket with back plate 9, back stator 8, center plate 7, front stator 6, and front plate 2, holding them together as a single stacked assembly.

A spindle 3 is attached to the front rotor 4 and reaches through the back rotor 5 to drive the center shaft 18 of the dual concentric camshaft 101. The spindle 3 has fluid passages 20, 21, 22, 23 to feed hydraulic fluid (oil) through. These passages can also feed from the rear of the phaser through the camshaft 101. The oil is supplied from the engine oil system by two control valves (not shown in the figures). One of the control valves controls the oil feed 20, 21 to the front rotor 4. This oil moves through the passages 24, 25 of the rotor 4 to either side of the vanes to rotate the center shaft 18 to the desired position. The position is infinite within a set value between 30 to 70 degrees (usually around 50 degrees) of the crankshaft rotational position.

The rear rotor 5 is attached to the rear adapter 11, which drives the outside shaft 16 of the dual concentric camshaft, which is attached through first journal 15. A second control valve controls oil feed through passages 22, 23 in the area of the spindle 3 that reaches through the rear rotor 5. The oil moves through passages 26, 27 to either side of the vanes of the rear rotor 5 to rotate the outer shaft 16 to a desired position. The position is infinite within a set value between 30 to 70 degrees (usually around 50 degrees) of the crankshaft rotational position.

At engine startup both rotors 4, 5 can be locked (in an alternative example embodiment) in a determined position when the rotors 4, 5 are in the locked position with the lock pins 34. The lock pins are held in place by the lock spring 35 and spring plate 36. As the engine starts and the control valves feed the oil pressure to disengage the lock pins 34 the rotors are free to move.

A1though the invention has been described in connection with various illustrated embodiments, numerous modifications and adaptations may be made thereto without departing from the spirit and scope of the invention as set forth in the claims.

REFERENCE LIST

| Reference Numeral | Significance | Drawing |
|---|---|---|
| 1 | Cam phasing device | FIG. 1, FIG. 2, FIG. 8, FIG. 9 |
| 2 | Front plate | FIG. 2, FIG. 8 |
| 3 | Spindle | FIG. 2 |
| 4 | First rotor or front rotor | FIG. 2, FIG. 7, FIG. 8, FIG. 9 |
| 5 | Second rotor or back rotor | FIG. 2, FIG. 8, FIG. 9 |
| 6 | First stator or front stator | FIG. 2, FIG. 8 |

-continued

Figure 3:
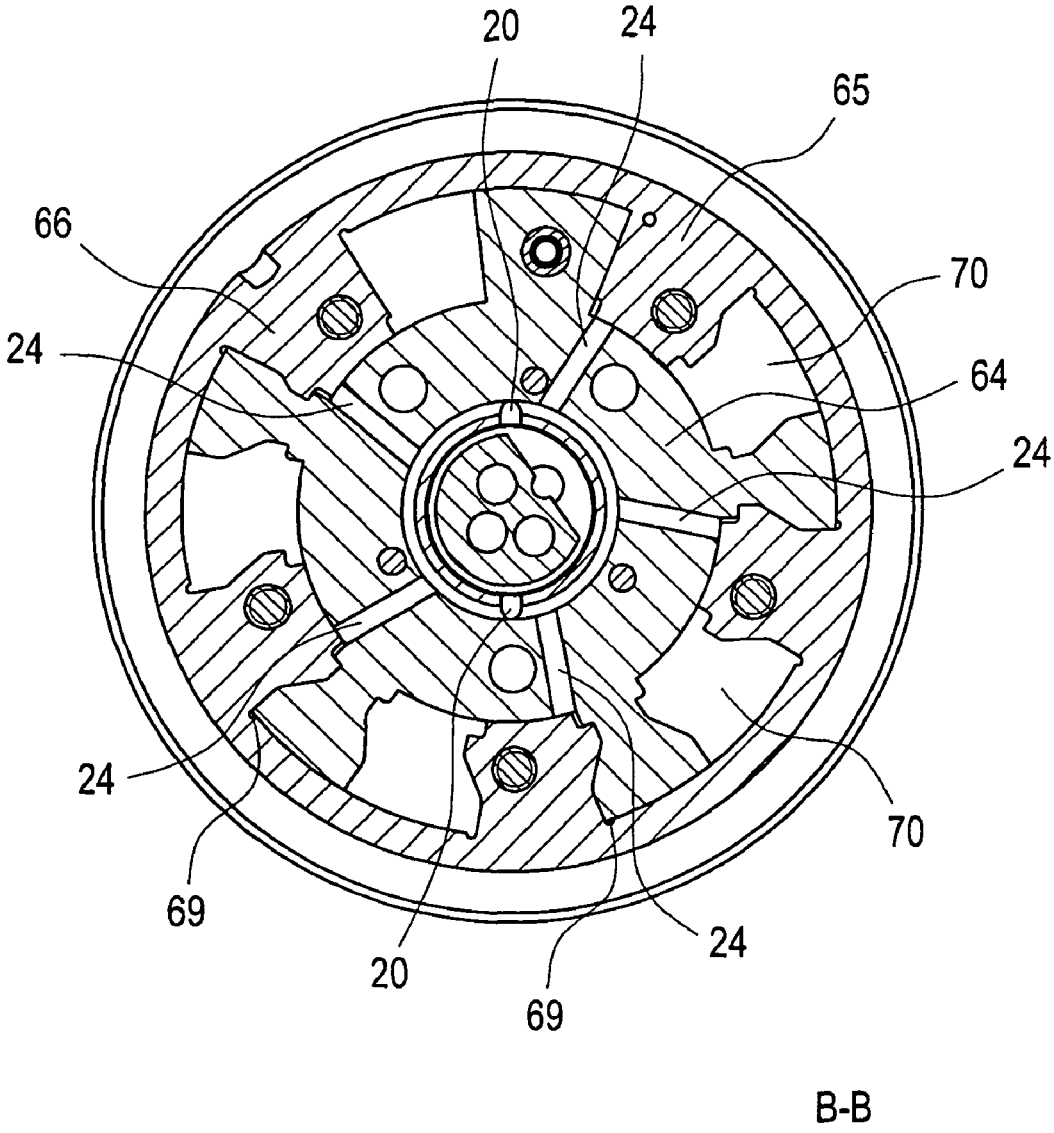
FIG. 3 shows an example cam phasing device of FIG. 1 along the line B-B of FIG. 2.
Figure 4:
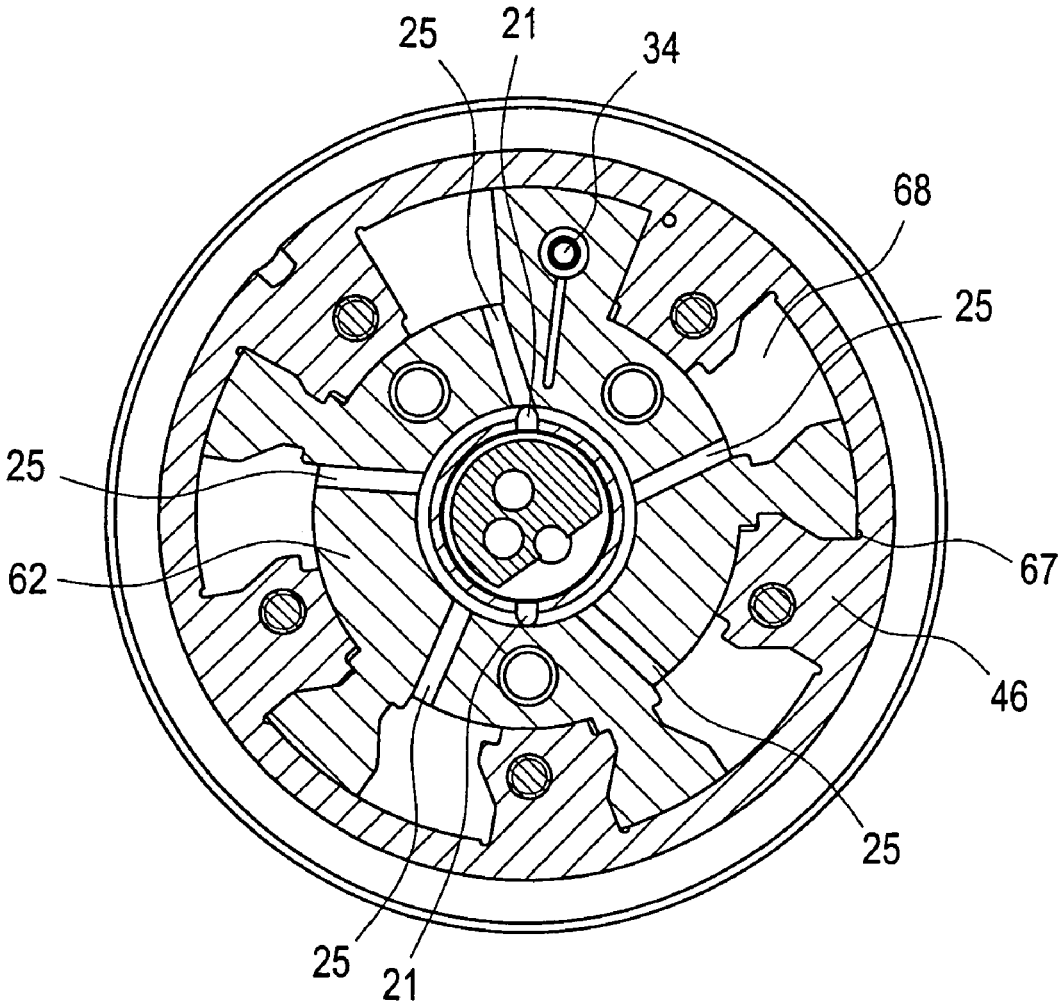
FIG. 4 shows an example cam phasing device of FIG. 1 along the line C-C of FIG. 2.
Figure 5:
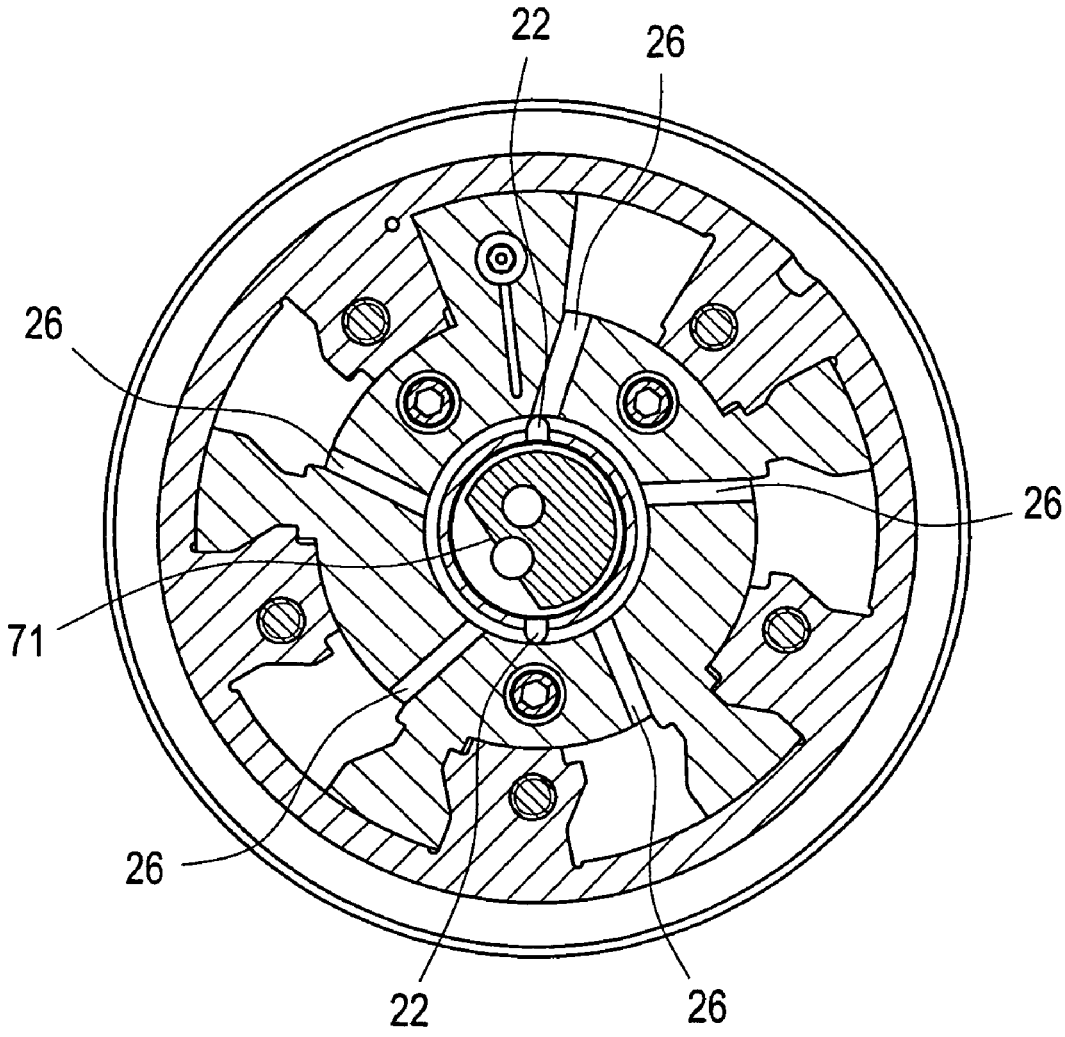
FIG. 5 shows an example cam phasing device of FIG. 1 along the line D-D of FIG. 2.
Figure 6:
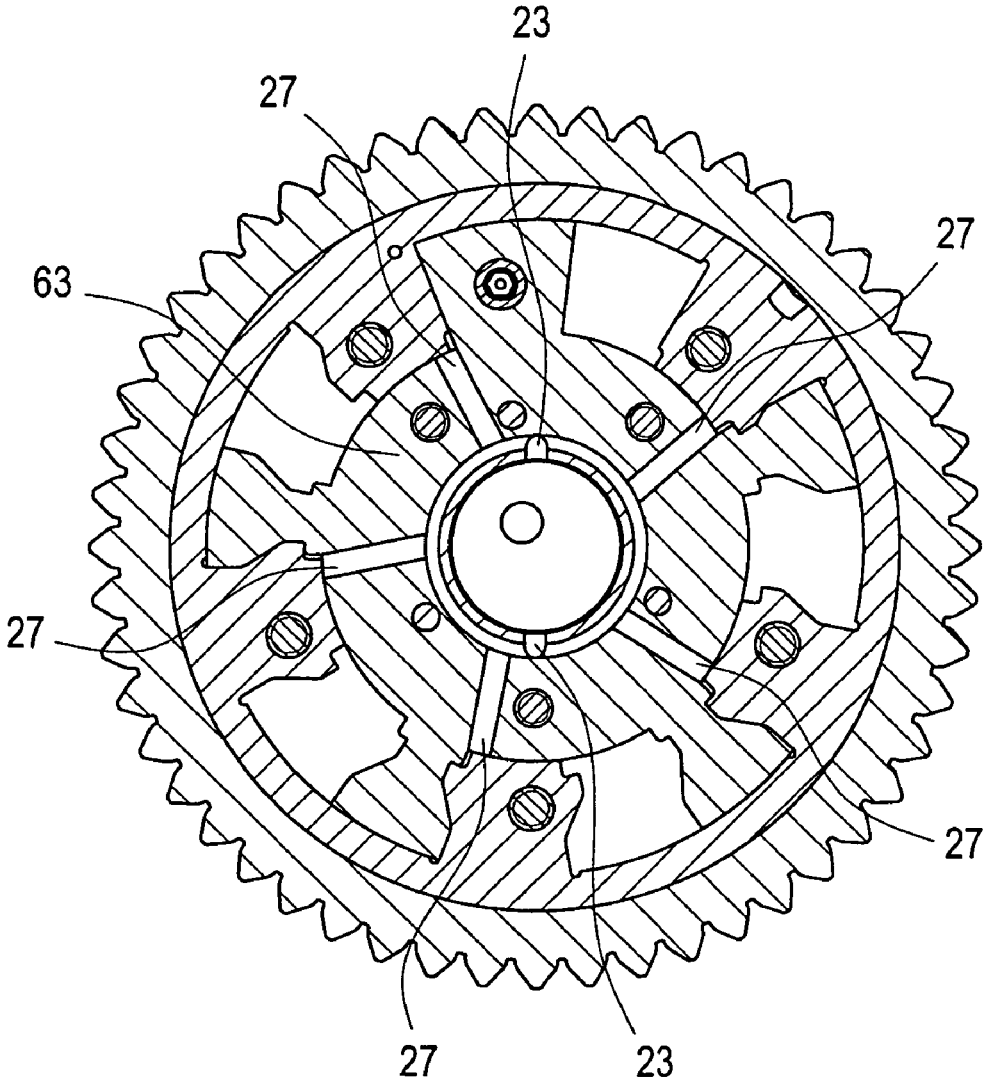
FIG. 6 shows an example cam phasing device of FIG. 1 along the line E-E of FIG. 2.

| Reference Numeral | Significance | Drawing |
|---|---|---|
| 7 | Center plate, especially as shared center plate | FIG. 2, FIG. 8 |
| 8 | Second stator or back stator | FIG. 2, FIG. 8 |
| 9 | Back plate | FIG. 2, FIG. 8 |
| 10 | Screw | FIG. 2 |
| 11 | Rear adapter | FIG. 2, FIG. 8 |
| 12 | Countersunk screw | FIG. 2, FIG. 8 |
| 13 | Recoil spring | FIG. 2, FIG. 8 |
| 14 | Retainer | FIG. 2, FIG. 8 |
| 15 | First journal | FIG. 2, FIG. 8 |
| 16 | Outside shaft | FIG. 2, FIG. 8, FIG. 9 |
| 17 | Camshaft bearing | FIG. 2 |
| 18 | Second camshaft as a center shaft | FIG. 2, FIG. 8, FIG. 9 |
| 19 | Oil distribution adapter | FIG. 2, FIG. 8 |
| 20 | First fluid passage | FIG. 1, FIG. 2, FIG. 3 |
| 21 | Second fluid passage | FIG. 1, FIG. 2, FIG. 4 |
| 22 | Third fluid passage | FIG. 1, FIG. 2, FIG. 5 |
| 23 | Fourth fluid passage | FIG. 1, FIG. 2, FIG. 6 |
| 24 | First passage | FIG. 3, FIG. 8 |
| 25 | Second passage | FIG. 4, FIG. 8 |
| 26 | Third passage | FIG. 5, FIG. 8 |
| 27 | Fourth passage | FIG. 6, FIG. 8 |
| 28 | First port | FIG. 9 |
| 29 | Second port | FIG. 9 |
| 30 | Third port | FIG. 9 |
| 31 | Fourth port | FIG. 9 |
| 32 | Communication collar | FIG. 9 |
| 33 | Inflow for the hydraulic medium | FIG. 2 |
| 34 | Lock pin | FIG. 4, FIG. 7 |
| 35 | Lock spring | FIG. 7 |
| 36 | Spring plate | FIG. 7 |
| 37 | Signal plate | FIG. 1 |
| 38 | Axis of the camshaft | FIG. 2, FIG. 9 |
| 39 | Perpendicular on the axis of the camshaft | FIG. 9 |
| 40 | Axial arrangement, especially in respect of the camshaft | FIG. 8, FIG. 9 |
| 41 | Near side to the camshaft | FIG. 9 |
| 42 | Far side from the camshaft | FIG. 9 |
| 43 | Drive wheel | FIG. 1, FIG. 8 |
| 44 | Sprocket | FIG. 1, FIG. 9 |
| 45 | Stator housing | FIG. 8, FIG. 9 |
| 46 | Drive torso | FIG. 1, FIG. 4, FIG. 8, FIG. 9 |
| 47 | Lid of the cam phasing device | FIG. 8 |
| 48 | Sealing sleeve | FIG. 8 |
| 49 | Sealing | FIG. 8 |
| 60 | First layer of a cam phasing device | FIG. 9 |
| 61 | Second layer of a cam phasing device | FIG. 9 |
| 62 | First output member | FIG. 4 |
| 63 | Second output member | FIG. 6 |
| 64 | Vane rim | FIG. 1, FIG. 3 |
| 65 | First bar | FIG. 3 |
| 66 | Second bar | FIG. 3 |
| 67 | First chamber | FIG. 4, FIG. 8 |
| 68 | Second chamber | FIG. 4, FIG. 8 |
| 69 | First set of chambers | FIG. 3 |
| 70 | Second set of chambers | FIG. 3 |
| 71 | Center of the cam phasing device | FIG. 5 |
| 100 | Valve train | FIG. 2 |
| 101 | Camshaft, especially double camshaft | FIG. 9 |
| 102 | Gas exchange valve control shaft | FIG. 9 |
| 103 | Cam of the first type | FIG. 9 |
| 104 | Cam of the second type | FIG. 9 |
| 105 | Clearance of the first camshaft, especially for reach-through of a cam | FIG. 9 |
| A-A | Section | FIG. 1 |
| B-B | Section | FIG. 2, FIG. 3 |
| C-C | Section | FIG. 2, FIG. 4 |
| D-D | Section | FIG. 2, FIG. 5 |
| E-E | Section | FIG. 2, FIG. 6 |
| F-F | Section | FIG. 7 |
| A1 | Oil channel system for the first set of chambers | FIG. 8 |
| B1 | Oil channel system for the first set of chambers | FIG. 8 |

-continued

| Reference Numeral | Significance | Drawing |
|---|---|---|
| A2 | Oil channel system for the first set of chambers | FIG. 8 |
| B2 | Oil channel system for the first set of chambers | FIG. 8 |
| P | Hydraulic media under pressure | FIG. 8 |
| $\phi$ | Angle of rotation | FIG. 1 |

What is claimed is:

1. A variable valve timing device for an internal combustion engine, comprising:

a gas exchange valve control shaft which has first and second concentrically arranged cam shafts that are adjustable in a rotatable manner with respect to each other, by which a cam of said first cam shaft is adjusted in terms of its angle towards a cam of said second cam shaft;

a cam phasing device which operates by rotatable vanes provoking a swivelling relative movement between a driven member and an output member, the cam phasing device comprising at least two pivotable vane adjusters, each pivotable vane adjuster is assigned to one of the two cam shafts, and said pivotable vane adjusters are arranged axially one after the other in a direction of the gas exchange valve control shaft;

said cam phasing device having only one drive pulley, said drive pulley comprising a sprocket adapted to be driven by a chain which can surround a crank shaft of said internal combustion engine; and said variable valve timing device having a side which is a near side of said first and second concentrically arranged cam shafts and a side which is a far side from said first and second concentrically arranged cam shafts and having a communication collar on said near side which bears conduits for intake and piping of a hydraulic fluid to each of two sets of hydraulic chambers of said first and said second pivotable vane adjuster;

wherein said communication collar moves synchronously along with said drive pulley.

2. The variable valve timing device of claim 1, wherein:

each pivotable vane adjuster is designed as a rotor type vane adjuster which can be changed in respect of its phase by hydraulic pressure in said two sets of hydraulic chambers;

said two sets of hydraulic chambers form counter moving chambers to each other and said pivotable vane adjusters each constitute an output member of one of said cam shafts;

each output member comprises a vane rim; and said vane rims are attached to rotor cores being movable between a first position and a second position limited by division bars of a surrounding stator housing.

3. The variable valve timing device of claim 2, further comprising:

an oil distribution adapter centered in the cam phasing device, said cam phasing device being penetrated by at least four longitudinal fluid passages each one of a different length so that each fluid passage opens out into one of said sets of hydraulic chambers.

4. The variable valve timing device of claim 2, wherein:

one of said output members is located farther away from said gas exchange valve control shaft and operates said second cam shaft which is an inner cam shaft in comparison to said first cam shaft;

one of said output members is located nearer to said gas exchange valve control shaft and operates said first cam shaft which is an outer cam shaft and encloses said inner cam shaft;

said output member which is farther away is screwed to said inner cam shaft; and said output member which is located nearer to said gas exchange valve control shaft is shrunken onto said outer cam shaft.

5. The variable valve timing device of claim 1, wherein:

said gas exchange valve control shaft is a coaxially arranged double cam shaft of which said first cam shaft is formed as a hollow body and in said hollow body said second cam shaft is aligned and placed in a manner so that through at least one recess a cam of said second cam shaft pokes out to an outside of said first cam shaft.

6. The variable valve timing device of claim 1, further comprising:

two conduits which are located in a vicinity of an axis of said first and second concentrically arranged cam shafts which channel said fluid from said communication collar to said pivotable vane adjuster which is located farther away from said communication collar than said second pivotable vane adjuster; and two conduits which are located remotely to said axis of said first and second concentrically arranged cam shafts which channel from said communication collar to said second pivotable vane adjuster which is located nearer to said communication collar.

7. The variable valve timing device of claim 1, further comprising:

four hydraulic ports which are placed in said communication collar to form channels from a stationary part of said internal combustion engine to each of said two sets of hydraulic chambers so that said communication collar forms part of a bearing ring and by which said hydraulic fluid is tuneable in each channel.

8. The variable valve timing device of claim 7, further comprising:

at least one spring which is placed at said driven member and which props on one side against said pulley to push at least one of said pivotable vane adjusters in a preselected state.

* * * * *